US007503812B2

(12) United States Patent
Arai

(10) Patent No.: US 7,503,812 B2
(45) Date of Patent: Mar. 17, 2009

(54) CONNECTOR TERMINAL

(75) Inventor: Atsushi Arai, Toyama (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 12/055,631

(22) Filed: Mar. 26, 2008

(65) Prior Publication Data

US 2009/0036002 A1 Feb. 5, 2009

(30) Foreign Application Priority Data

Jul. 31, 2007 (JP) ..... 2007-199857

(51) Int. Cl.
*H01R 13/40* (2006.01)

(52) U.S. Cl. ..... 439/752.5

(58) Field of Classification Search ..... 439/752.5, 439/746, 748, 749, 872
See application file for complete search history.

(56) References Cited

U.S. PATENT DOCUMENTS 2,463,826 A * 3/1949 Thacker ..... 439/715
3,998,518 A * 12/1976 Mathe ..... 439/346

FOREIGN PATENT DOCUMENTS

JP 2006-216324 A 8/2006

* cited by examiner

*Primary Examiner*—Phuong K Dinh
(74) *Attorney, Agent, or Firm*—Darby & Darby P.C.

(57) ABSTRACT

A connector terminal for insertion in a terminal storage chamber of a connector housing has a terminal housing body that is formed by bending a plate material into a somewhat cylindrical form. A plurality of stabilizers are erected in at least three positions directed radially away from a centerline running along an insertion direction of the terminal housing body such that the terminal housing body is rotatable about the centerline. At least one stabilizer is formed by outwardly bending a portion of the plate material that runs along the insertion direction of the terminal housing body, and at least another stabilizer is formed by making a cut from the side wall of the terminal housing body.

2 Claims, 5 Drawing Sheets

CONNECTOR TERMINAL

CROSS-REFERENCE TO RELATED APPLICATION

The present application claims priority from Japanese Patent Application No. JP2007-199857, which was filed on Jul. 31, 2007 and is hereby incorporated by reference in its entirety herein.

FIELD OF THE INVENTION

The present invention relates to a connector terminal construction that is inserted and installed within a connector housing.

BACKGROUND OF THE INVENTION

An example of a connector terminal that is inserted and assembled in the connector housing is shown in the external view in FIG. 3(*a*), and FIG. 3(*b*) shows an enlarged view of a cross-sectional end face of view B-B, in which a publicly known form of a connector terminal 110 has been formed by bending a plate material into a somewhat cylindrical form with a cross-sectional ring shape. This connector 110 has a lance 114 and stabilizer 113 that are formed through a cut in the side wall of the terminal housing body 111 in the intermediate space along the insertion direction of the terminal housing body 111.

FIG. 3(*c*) shows this connector terminal 110 as it is installed within the connector housing 120, and FIG. 3(*d*) shows a cross-sectional end face drawing in which the stabilizer 113 in its installed state is cross-cut in the terminal insertion direction and right-angle direction. In order to position the connector terminal 110 within the terminal storage chamber of the connector housing as shown in FIG. 3(*d*), it is necessary to provide at least approximately three stabilizers 113 in the circumferential direction with respect to the insertion direction of the terminal.

However, when as many as three stabilizers 113 are cut into the terminal housing body 111, the cross-sectional area needed for conductivity within the terminal housing body is reduced because of the notch that is provided in order to make the cut, which is unfavorable in cases where large amounts electrical current are used.

Further, as shown in FIG. 4(*a*), with the number of stabilizers 113 set to two, and as shown in FIGS. 4(*b*) and 4(*c*), in which a guide groove 121 is provided on the side of the connector housing 120 to hold the stabilizer, it becomes necessary in such a case to line up the position of the stabilizer in the guide groove during insertion and assembly of the connector terminal, which results in a drop in assembly productivity.

In Published Unexamined Japanese Patent Application No. 2006-216324, a technology is disclosed in which a stabilizer is formed by stretching a portion of the plate material that forms the terminal housing body at an edge of the material, but because of the inevitable need for engaging the stabilizer in a guide groove, the directional movement that occurs after installation adversely affects the assembly process.

SUMMARY OF THE INVENTION

In light of the technological problems noted above, it is an object of the present invention to provice a connector terminal that can be inserted and installed without directionality in the peripheral direction with respect to the insertion direction during insertion and assembly of the connector terminal in the terminal storage chamber of the connector housing, as well as a connector terminal with excellent conductivity.

The present invention is a connector terminal that is inserted and installed within a terminal storage chamber of a connector housing, which has a terminal housing body that is formed by bending a plate material into a somewhat cylindrical form. As for the terminal housing body, a stabilizer that makes contact with the inner wall of the terminal storage chamber in which there is no guide groove for the stabilizer is erected in a radial fashion such that it is rotatable about an axis extending along an insertion direction of the terminal, and such that it is erected in at least three directions radially positioned about the axis. At least one stabilizer is formed by outwardly bending a portion of the plate material that forms the terminal housing body about an edge of the plate material that runs along an insertion direction of the terminal, and another stabilizer is formed by making a cut from the side wall of the terminal housing body.

Here, the terminal storage chamber in which there is no guide groove for the stabilizer refers to the fact that there is no guide groove for determining a position for inserting the stabilizer, such that during insertion and assembly of the connector terminal in the housing, there are no limits with regard to the position in the peripheral direction of the connector terminal.

With the connector terminal according to the present invention, at least one of the stabilizers in the three or more directions along the periphery of the connector terminal is not cut from the plate material that forms the terminal housing body. As compared to conventional cases in which all stabilizers are formed through cutting for the purpose of outwardly bending and forming the stabilizers, there is a smaller increase in electrical resistance as results from forming stabilizers using a cutting process, and therefore excellent conductivity is achieved.

BRIEF DESCRIPTION OF THE DRAWINGS

The invention will become more readily apparent from the Detailed Description of the Invention, which proceeds with reference to the drawings, in which;

FIG. 1(*b*) is a bottom surface view of the connector terminal;

FIG. 1(*c*) is an enlarged view of a cross-sectional end face of view A-A;

FIG. 1(*d*) is an explanatory drawing of the connector terminal installed within a connector housing, such that the front side of the connector housing is removed;

FIG. 1(*e*) is an explanatory drawing of the connector terminal installed within the connector housing with an enlarged view of a cross-sectional end face that is cut away in the engagement direction and right angle of the connector near the stabilizers;

DETAILED DESCRIPTION OF THE INVENTION

Figure 1A:
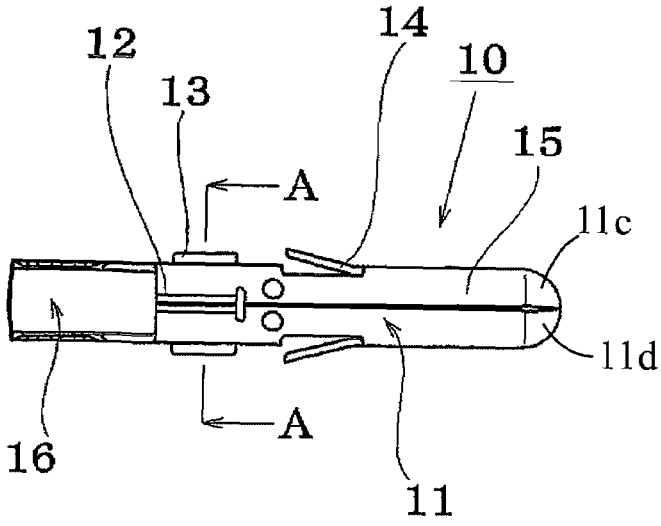
FIG. 1(*a*) is a plan view of a connector terminal according to the present invention.
Figure 1C:
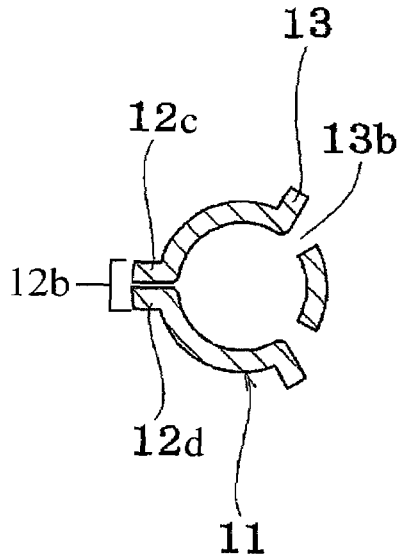
Figure 1B:
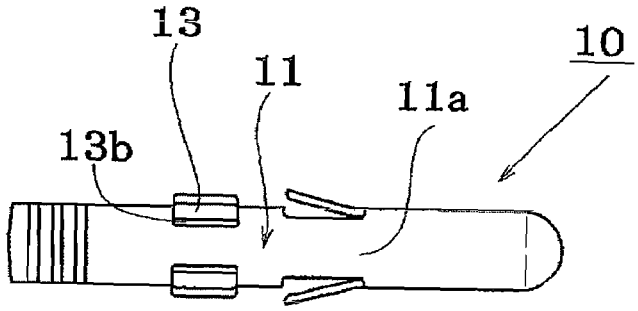
Figure 1D:
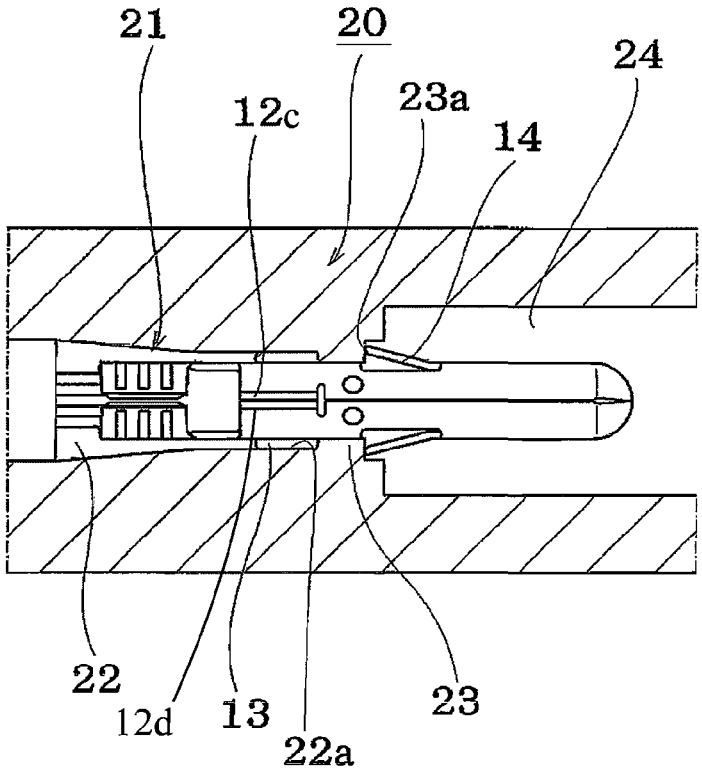
Figure 1E:
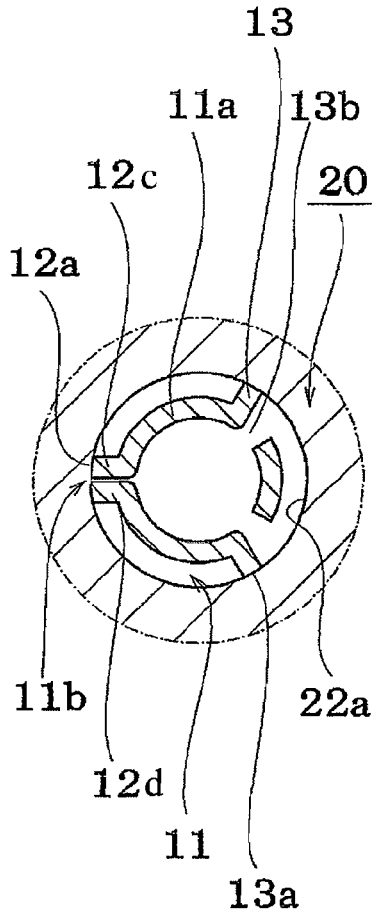

The following listing provides a key to the reference numerals and elements depicted in the drawings.

10: Plug-type connector terminal
11: Connector housing body
11*a:* Side wall of connector housing body
11*b:* Aligning part for plate material
11*c*, 11*d*: Edges of plate material running in insertion direction of the terminal 11
12: Stabilizer formed by bending extended portion of the plate material insulation part
12*a:* Outer end of stabilizer
12*b*: Stack
12*c*, 12*d*: Bent portions
13: Stabilizer formed through a cut-away process
13*a:* Outer end of stabilizer
13*b:* Notch
14: Lance
15: Contact part
16: Electric line connection part
20: Connector housing
21: Terminal storage chamber
22: Electric line storage part
22*a:* Side wall of electric line storage part
23: Circular convex part
23*a:* Lance clip part
24: Connection space part The connector terminal construction according to the present invention can be widely applied to connectors that are inserted and assembled in housings, and FIGS. 1(*a*)-(*d*) show explanatory drawings of an embodiment that is applied to a plug type connector terminal 10.

FIG. 1(*a*) shows a plan view of the connector terminal 10. FIG. 1(*b*) shows a bottom surface view of the same, and FIG. 1(*c*) shows an enlarged view of a cross-sectional end face of view A-A.

The connector terminal 10 is formed through a process in which a punched metal plate material is bent into a somewhat cylindrical shape.

On the front end side of the connector terminal 10 in the direction of insertion toward the connector housing, a contact part 15 is formed nearly in the shape of a round pin for the purpose of connecting a mating side connector terminal, and a cylindrical terminal housing body 11 is provided in the intermediate space in the lengthwise direction. On the rear end side, an electric line connection part 16 is provided so that a crimp-style connection of the electric line is possible.

The terminal housing body 11 is equipped with a lance 14 for locking the connector terminal 10 within the connector housing using a snapping operation, as well as stabilizers 12 and 13 for stabilizing the installation posture of the connector terminal 10 toward the inside of the connector housing.

FIG. 1(*d*) shows an explanatory drawing of the connector terminal 10 installed within a connector housing 20, such that the front side of the connector housing 20 is removed. FIG. 1(*e*) shows the connector terminal 10 installed within the connector housing 20 with an enlarged view of a cross-sectional end face that is cut away in the engagement direction and right angle of the connector near the stabilizers 12 and 13.

The connector housing 20 is equipped with a terminal storage chamber 21 that passes through in the engagement direction of the connector, a connection space part 24 on the front side in the engagement direction, an electric line storage part 22 on the rear side, and a circular convex part 23 that protrudes in the shape of a ring from the side wall of the terminal storage chamber 21 to the space between the connection space part 24 and the electric line storage part 22.

The connector terminal 10 is inserted from the electric line storage part 22 into the connector housing 20, and with the front end in the engagement direction of the stabilizers 12 and 13 at the position where it nearly hits against the circular convex part 23, the lance 14 elastically snaps onto a lance clip part 23*a* belonging to the circular convex part 23 to install the connector terminal 10 in the terminal storage chamber 21.

A side wall 22*a* of the electric line storage part 22 is formed such that the parts that correspond to the stabilizers 12 and 13 of the connector terminal 10, which is in its installed state, are cross-sectional circular shapes concentric to the somewhat cylindrical axis of the connector terminal 10 and such that outer ends 12*a* and 13*a* of the stabilizers 12 and 13 nearly make uniform contact.

Thus, regardless of the directionality of the peripheral direction with respect to the insertion axis of the connector terminal 10, the stabilizers 12 and 13 make contact with the side wall 22*a* such that positioning can be achieved with the installation posture of the connector terminal 10 stabilized.

The circular convex part 23 is formed in a circular shape concentric to the somewhat cylindrical axis of the connector terminal 10, and regardless of the directionality of the peripheral direction with respect to the insertion axis of the connector terminal 10, it is possible to elastically lock the lance 14 into place.

A pair of lances 14 are symmetrically positioned in the peripheral direction of the terminal housing body 11 by forming a cut-away from the terminal housing body, and these are angled such that they separate from the front side to the rear side in their respective engagement directions.

At an aligning part 11*b* of the plate material used to form the terminal housing body 11, two stabilizers 12 are formed in a stack 12*b* when two portions 12*c*, 12*d* of the plate material that forms the terminal housing body 11 are respectively bent about opposing edges 11*c*, 11*b* of the plate material that run along the insertion direction of the terminal 11, thereby extending outwardly to in combination form the aligning part 11*b*.

At a position of approximately 120 degrees on both sides in the peripheral direction from the aligning part 11*b* of the terminal housing body 11, stabilizers 13 are provided that are formed through a cut-away process.

Each stabilizer is formed by outwardly bending a protruding arm equipped with a notch 13*b* formed on a side wall 11*a* of the terminal housing body.

It is acceptable for two or more stabilizers 13 to be provided through a cut-away forming process.

The stabilizers 12 and 13 are parallel to the insertion direction toward the respective terminal storage chambers 21 of the connector terminal 10, and they outwardly protrude in the cylindrical radial direction of the terminal housing body 11.

Figure 2:
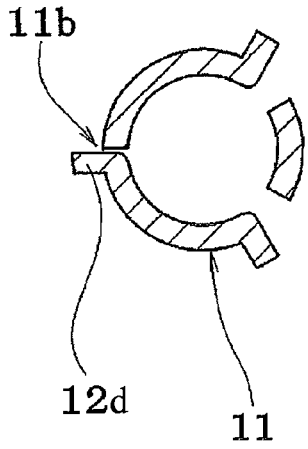
FIG. 2 is a cross-sectional end view of a stabilizer part in the case where only one portion of the plate material is bent about one edge of the plate material along an insertion direction of the terminal to provide a stabilizer.
Figure 3A:
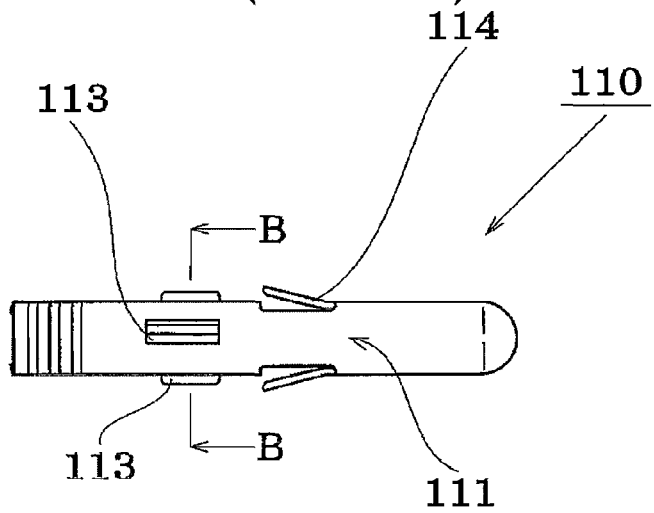
Figure 3(a) (Prior Art)
FIGS. 3(*a*)-3(*d*) are explanatory drawings of a first conventional connector terminal construction.
Figure 3B:
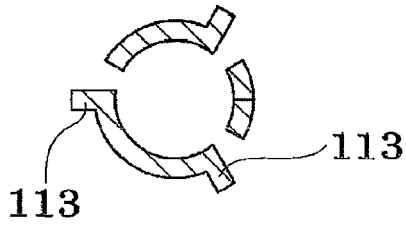
Figure 3(b) (Prior Art)
Figure 3C:
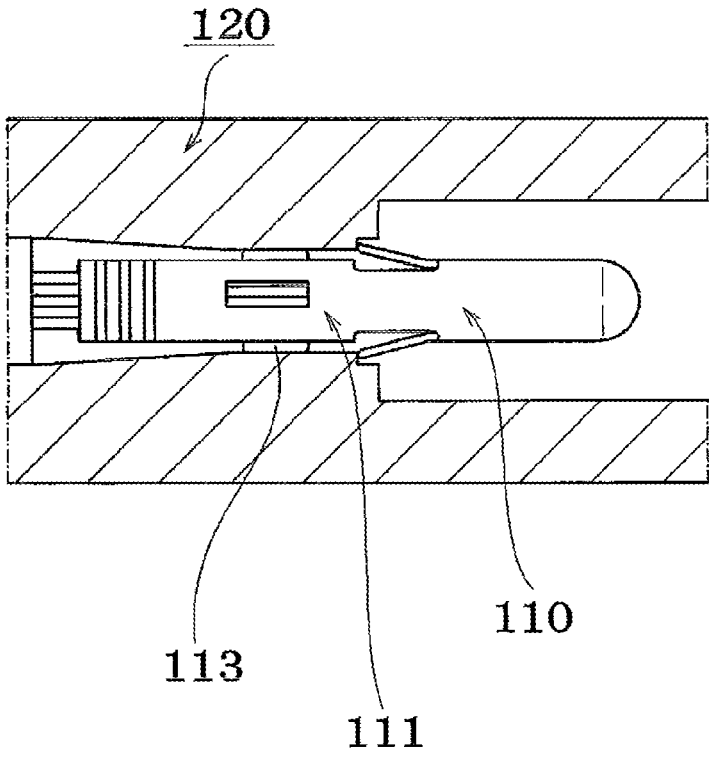
Figure 3(c) (Prior Art)
Figure 3D:
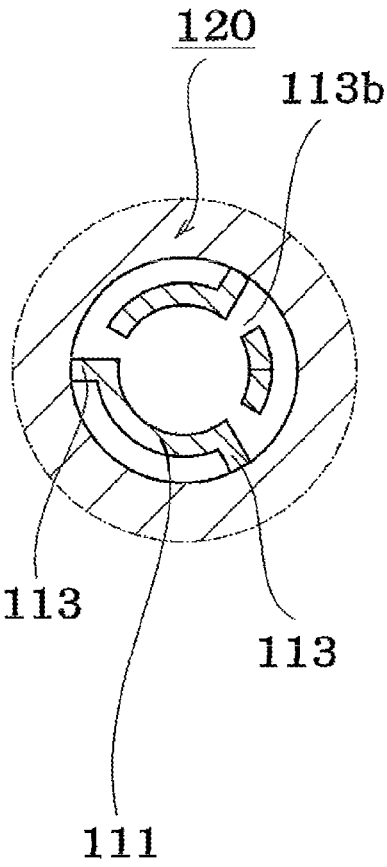
Figure 3(d) (Prior Art)
Figure 4A:
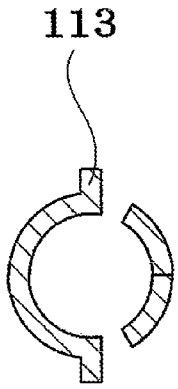
Figure 4(a) (Prior Art)
FIGS. 4(*a*)-4(*c*) are explanatory drawings of a second conventional connector terminal. 4 is an explanatory drawing
Figure 4B:
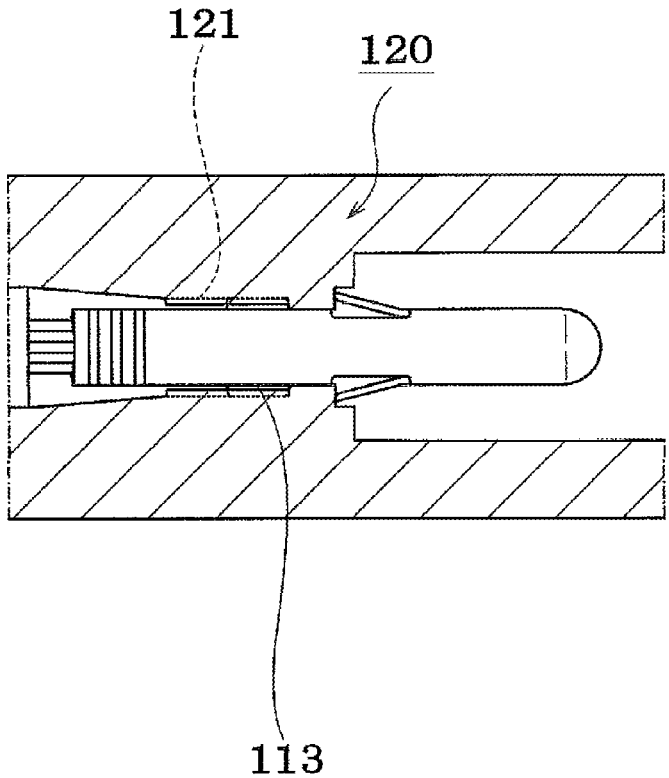
Figure 4(b) (Prior Art)
Figure 4C:
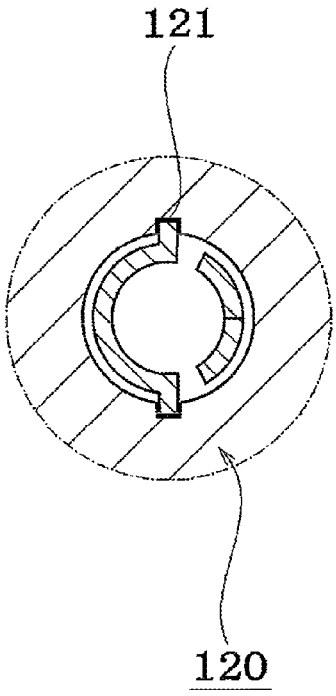
Figure 4(c) (Prior Art)

As shown in FIG. 2, the stabilizers 12 provided at the aligning part 11*b* of the plate material may be formed by bending only one portion 12*d* of the plate material that forms the terminal housing body 11 about corresponding edge 11*b* of the plate material that run along the insertion direction of the terminal 11. In this case, the portion 12*c* of the plate material is omitted.

With regard to the connector terminal 10, at least one of the stabilizers provided on the terminal housing body 11 does not need to be a stabilizer 13 formed through a cut-away process, and by outwardly bending the insulation part of the plate material that forms the connector terminal 10, not only is a drop in strength prevented, but an increase in electrical resistance due to a reduction of the cross-sectional area can also be prevented, and thus it is particularly favorable to apply this approach for the sake of conductivity when large amounts electrical current are used.

Moreover, the application of the connector terminal construction according to the present invention is not limited to connector terminals used for unipolar contacts, and therefore this construction can also be applied to connector terminals used for multipolar contacts of a conventional connector terminal construction.

It is within the scope of the present invention to include all foreseeable equivalents to the elements of the present invention described with reference to FIGS. 1(*a*)-2. The examples provided by the disclosure are not to be interpreted as limiting the invention beyond that which is claimed.

The invention claimed is:

1. A connector terminal that is inserted and installed within a terminal storage chamber of a connector housing, which has a terminal housing body that is formed by bending a plate material into a substantially cylindrical form, wherein the terminal housing body comprises a plurality of stabilizers that make contact with an inner wall of the terminal storage chamber in which there is no guide groove for the stabilizer, the stabilizers being erected in at least three positions directed radially away from a centerline along an insertion direction of the terminal housing body such that the terminal housing body is rotatable about the centerline, and with at least one of the plurality of stabilizers being formed by outwardly bending a portion of the plate material about a first edge of the plate material that runs along an insertion direction of the terminal, and at least another one of the plurality of stabilizers being formed by making a cut from a side wall of the terminal housing body, wherein at least one of three stabilizers in the at least three positions is formed by outwardly bending the portion of the plate material about the first edge of the plate material that runs along the insertion of the terminal housing body; wherein second and third ones of the three stabilizers are each formed by making a cut from the side wall of the terminal housing body and wherein adjacent ones of the at least three stabilizers are radially positioned approximately 120 degrees apart.

2. The connector terminal of claim 1, wherein the at least one of the three stabilizers and another one of the plurality of stabilizers are formed as a stack by outwardly bending the portion of the plate material about the first edge of the plate material and bending another portion of the plate material about a second edge of the plate material, the second edge running in opposition to the first edge and the stack formed by the two bent portions of the plate material.

* * * * *